United States Patent [19]

Shigeta et al.

[11] Patent Number: 4,482,452

[45] Date of Patent: Nov. 13, 1984

[54] PROCESS FOR PREPARING RAW MATERIAL FOR PRODUCING CARBON MATERIAL

[75] Inventors: Masatomo Shigeta; Yosio Isii; Akio Hoshi, all of Iwaki, Japan

[73] Assignees: Kureha Kagaku Kogyo Kabushiki Kaisha, Tokyo; Sumitomo Metal Industries, Limited, Osaka, both of Japan

[21] Appl. No.: 379,881

[22] Filed: May 19, 1982

[30] Foreign Application Priority Data

May 29, 1981 [JP] Japan ..... 56-83598

[51] Int. Cl.[3] ..... C10G 21/12; C10G 29/02

[52] U.S. Cl. ..... 208/177; 210/734; 210/704; 208/39

[58] Field of Search ..... 208/177, 39; 210/734, 210/704

[56] References Cited

U.S. PATENT DOCUMENTS

| | | | |
|---|---|---|---|
| 2,587,643 | 3/1952 | Myers | 196/14.46 |
| 3,321,394 | 5/1967 | Mills | 208/45 |
| 3,479,284 | 11/1969 | Lees | 210/734 |
| 3,507,787 | 4/1970 | Pratt et al. | 210/734 |
| 3,784,526 | 1/1974 | Ribba | 210/734 |
| 4,132,630 | 1/1979 | Carr et al. | 208/177 |
| 4,148,716 | 4/1979 | Paraskos et al. | 208/177 |
| 4,177,134 | 12/1979 | Rhodes et al. | 208/177 |
| 4,191,628 | 3/1980 | McDowell | 208/177 |

FOREIGN PATENT DOCUMENTS

| | | |
|---|---|---|
| 302941 | 12/1928 | United Kingdom . |
| 312657 | 5/1929 | United Kingdom . |
| 314405 | 6/1929 | United Kingdom . |
| 312228 | 11/1930 | United Kingdom . |
| 657641 | 9/1951 | United Kingdom . |
| 708052 | 4/1954 | United Kingdom . |
| 934986 | 8/1963 | United Kingdom . |
| 2051118A | 1/1981 | United Kingdom . |

OTHER PUBLICATIONS

CPI-Basic Abstracts Journal, J5 0039-317, (1976).

*Primary Examiner*—Delbert E. Gantz
*Assistant Examiner*—Cynthia A. Prezlock
*Attorney, Agent, or Firm*—Oblon, Fisher, Spivak, McClelland & Maier

[57] ABSTRACT

The present invention relates to a process for preparing raw material containing small amount of quinoline-insoluble component for producing carbon material, comprising the steps of admixing a heavy oil of coal origin or of petroleum origin with an organic solvent having a boiling point of lower than 150° C. and a surfactant which is soluble in the heavy oil and has de-foaming property and de-bubbling property, stirring the thus formed mixture gently with a motive power in a range of 0.5 to 50 watt/$m^3$ of the mixture, subjecting the mixture to centrifugation thereby removing the solid impurities, and distilling the remaining liquid thereby removing the light fraction to obtain the raw material.

8 Claims, 5 Drawing Figures

PROCESS FOR PREPARING RAW MATERIAL FOR PRODUCING CARBON MATERIAL

BACKGROUND OF THE INVENTION

The present invention relates to a process for removing quinoline-insoluble minute solid impurities from a heavy oil of coal origin or of petroleum origin by the steps of adding an organic solvent to the heavy oil, adding a surfactant to the resultant heavy oil, treating the resultant mixture by stirring to transform the quinoline-insoluble minute solid impurities into a floating substance on the surface of the mixture and removing the floating substance.

As a raw material for producing carbon material, heavy oils of coal origin and of petroleum origin have hitherto been extensively used because of the economical merit that heavy oil is converted to carbon material in a high rate of carbonization for its material cost. However, the allowable conditions of the properties of the heavy oil as a raw material for producing carbon material are very strict, for instance, in the case of the heavy oil of petroleum origin, since the sulfur content of the heavy oil of petroleum origin is generally high, only those of low sulfur content are selectively used. Namely, the range of selection is extremely limited.

On the other hand, in the case of the heavy oil of coal origin, its sulfur content is lower than that of petroleum origin and its rate of carbonization is higher than that of petroleum origin, however, the quinoline-insoluble minute solid impurities which are contained in only a small amount in the heavy oil of coal origin inhibit the graphitization of carbon materials, and accordingly, the heavy oil of coal origin is not desirable as the raw material for carbon material of high quality such as needle coke and that for carbon fiber. In addition, such quinoline-insoluble minute solid impurities are also contained in the heavy oil of petroleum origin although the content is small. The allowable content of the quinoline-insoluble minute solid impurities depends on the use of carbon material, and the so-called quinoline-insoluble component is less than 100 ppm for producing carbon fiber and less than 300 ppm for producing the other carbon material in general standard, the quinoline-insoluble component being determined by the method described later.

Consequently, if the solid impurities contained in the heavy oil of coal origin or of petroleum origin can be effectively removed, the resultant heavy oil can be utilized as the raw material for producing carbon material of high quality, and such a removal contributes largely in cost-reduction of the carbon material.

The quinoline-insoluble minute solid impurities in the heavy oil mean the floating particles of less than 500 microns in representative diameter consisting of carbon and inorganic salts, the floating particles being difficultly separated from the heavy oil or hardly precipitated. In order to separate the floating particles, i.e. the quinoline-insoluble minute solid impurities from the heavy oil, it is most general to apply an external force such as centrifugal force to the heavy oil for separating the floating particles and the heavy oil by the difference of densities. However, owing to the extreme fineness of the floating solid particles, it is impossible to sufficiently remove them from the heavy oil by simply subjecting the heavy oil to centrifugation. Accordingly, so far as the separation is carried out depending on the gravitational difference between the floating particles and the heavy oil, it becomes necessary to coagulate or agglomerate the minute particles into far larger particles.

A number of methods for removing the minute quinoline-insoluble component based on the principle have been hitherto proposed as follows:

(1) The method of thermal treatment of the heavy oil for bringing the size of the quinoline-insoluble solid particles larger and of removing the enlarged particles.

(2) The method of adding a heavy oil of petroleum origin to a heavy oil of coal origin, thereby adhering a high polymeric component (so-called gum-like component) to the quinoline-insoluble minute solid impurities to enlarge the size of the floating particles and if necessary, admixing an aromatic or aliphatic solvent therewith followed by stirring the resultant mixture while heating or by cooling the resultant mixture to separate and remove the thus formed insoluble precipitate (refer to Japanese Patent Applications Laying Open No. 55-104387 (1980) and No. 55-113606 (1980)).

(3) The method of admixing an organic solvent with the heavy oil, thereby agglomerating the minute insoluble precipitating material containing the quinoline-insoluble component into larger particles to separate and remove thereof (refer to Japanese Patent Applications Laying Open No. 55-136111 (1980), No. 56-49791 (1981) and No. 56-59611 (1981)).

However, the methods hitherto proposed are not the practically applicable and effective method because of the following reasons:

Namely, in the method (1), since the separated insoluble precipitate is extremely small in size, the speed with which the particles are separated is small, and the particles clog the mesh of filter-net on filtration resulting in the low efficiency of separation of insoluble precipitate. In addition, since it is necessary to carry out the separation or filtration at a high temperature in order to reduce the viscosity of the heavy oil to be treated, the method necessitates the high cost of installation and of operation which causes economic problem. In the method (2), since the formation of the insoluble precipitate takes a long time period at an ordinary temperature, the process necessitates a thermal treatment at a temperature as high as 200° C., stirring for a time period as long as several hours, a large amount of an expensive solvent and an apparatus for recovering the solvent, and accordingly, the method (2) is lacking in industrial efficiency and economic efficiency. In the method (3), the necessary amount of the organic solvent is 10 to 100 times of the amount of the heavy oil to be treated resulting in a very high cost of treatment. In addition, as in the method (2), the method (3) necessitates the apparata for cooling and leaving the thermally treated heavy oil under agitation to stand and for recovering and recycling the expensive solvent.

Furthermore, in the conventional method, some components of the heavy oil are brought into polycondensation by the heating of the heavy oil to cause the alteration of physical properties of the heavy oil to a large extent, and since those excessively polycondensed are removed together with the minute solid impurities, eventually the yield of carbonization of the product is reduced. This is one of the demerits of the conventional method.

It has been found by the present inventors that the quinoline-insoluble minute solid impurities can be removed effectively by adding a surfactant to the heavy oil and gently stirring the mixture, thereby agglomerating the minute solid impurities into far larger particles while utilizing the agglomerating effect of the surfactant instead of agglomerating the minute solid impurities by the formation of gum-like component according to the conventional method, and applying a centrifugal force with in the ordinary range to the heavy oil containing the thus formed larger particles.

It has been also found by the present inventors that in the case where an organic solvent of a boiling point of lower than 150° C. such as benzene is added to the heavy oil in advance of the addition of or together with the surfactant to the heavy oil, the viscosity of the thus obtained mixture is fairly reduced to facilitate the admixture of the surfactant and the gentle stirring of the thus obtained mixture thus facilitating the formation of the larger particles.

The thus added organic solvent is easily removed by simple distillation after removing the larger particles, and is used in circulation.

In the case where a commercialized surfactant is applied together with or without the organic solvent for the separation of the quinoline-insoluble minute solid impurities, it has been also found by the present inventors that it is necessary to fulfill the specified conditions of agitation or stirring when the surfactant is admixed with the heavy oil or the mixture of the heavy oil and the organic solvent in order to obtain the practically ideal separation of the minute solid impurities from the heavy oil.

The object of the present invention is to obtain a suitable raw material containing smaller amount of quinoline-insoluble solid impurities than in the concentrationally treated raw material for producing carbon material such as carbon fiber from heavy oils of petroleum origin or of coal origin.

DETAILED DESCRIPTION OF THE INVENTION

The present invention relates to a process for preparing heavy oil as a raw material for producing shaped materials of carbon, comprising the steps of dissolving a surfactant into a heavy oil as the starting material which is kept at a suitable viscosity by the addition of an organic solvent, thereby bringing the quinoline-insoluble minute solid impurities (hereinafter referred to simply as Q.I.) contained originally in the heavy oil into agglomerated larger particles in the thus formed mixture and subjecting the thus obtained mixture to centrifugation to separate and remove the larger particles.

More in detail, the present invention relates to a process for preparing a raw material containing a small amount of Q.I. for producing carbon materials, comprising the steps of admixing an organic solvent of a boiling point lower than 150° C. and a surfactant with a heavy oil of petroleum origin or of coal origin, stirring the resultant mixture by a stirring force within a specified range, subjecting the thus stirred mixture containing the agglomerated larger particles formed from Q.I. and the surfactant to centrifugally separating treatment, thereby removing Q.I. as the agglomerated larger particles and subjecting the Q.I. free heavy oil to distillation, thereby removing the light fractions including the organic solvent.

In the present invention, a heavy oil of coal origin means coal tars by-produced on dry distillation of coal such as high temperature tar and low temperature tar, and products of coal-liquefaction, and a heavy oil of petroleum origin means residual oils of distillation under an ordinary pressure or a reduced pressure, bottom oils of naphtha-cracking or of fluide-catalytic cracking, residual oil of solvent extraction, etc. Each heavy oil of the specified origin may be singly used or in combination.

Figure 1:
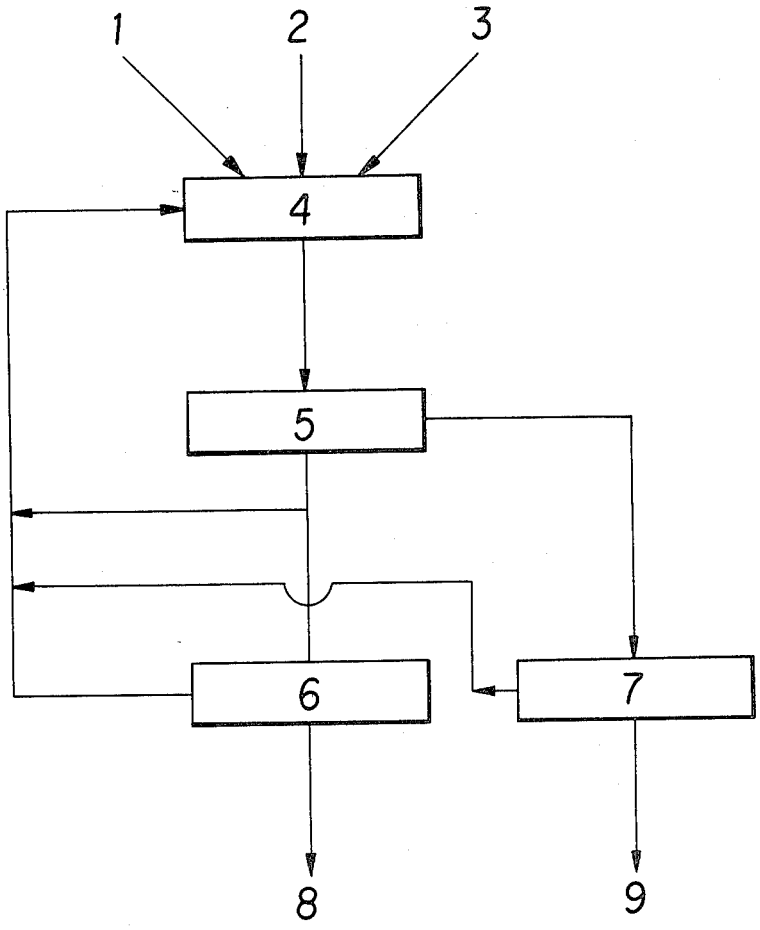
FIG. 1 is a simplified flow chart of the process according to the present invention.

The respective steps composing of the process of the present invention will be explained in their order as follows:

The material flow in the process of the present invention is exemplified in FIG. 1 wherein 1 is a heavy oil as the starting material, 2 is a surfactant, 3 is a solvent, 4 is a mixing vessel, 5 is the step of separation of solid impurities, 6 is the step of distillation for fractionation, 7 is the step of distillation for fractionation, 8 is a purified heavy oil and 9 is a tar containing solid materials.

(A) The step of addition of an organic solvent to the heavy oil

The viscosity-controlling agent is used for controlling the viscosity of the heavy oil to be treated in the process of agglomerating Q.I., and admixed with the heavy oil in advance of the addition of or together with the surfactant. The agent is selected from the organic solvents of low molecular weight and of a boiling point of lower than 150° C., for instance aromatic hydrocarbons such as benzene, toluene and xylene, and aliphatic compounds such as ketones, ethers and esters.

Such a viscosity-controlling agent is used in an amount of nearly equal to the amount of the heavy oil as the starting material for making the viscosity of the thus prepared mixture of the heavy oil and the agent (by stirring) less than 10 cp at 50° C.

Although various organic compounds may be used as the viscosity-controlling agent as mentioned above, from the economic consideration, it is advantageous to use a light fraction, obtained in the step of distillating-separation which will be described later, mainly consisting of benzene in circulation as shown in FIG. 1.

The addition of the viscosity-controlling agent to the heavy oil is carried out by a conventional procedure of adding an organic solvent to a heavy oil, and the thus obtained mixture is heated in a mixing vessel to a temperature within the range of 50° to 80° C. to reduce the viscosity of the mixture, thereby facilitating the next step of agglomeration of Q.I. by the surfactant.

(B) The step of admixing a surfactant with the mixture of the heavy oil and the organic solvent As a surfactant, one of the commercialized oil-soluble surfactants of de-emulsifying property and de-foaming property which are customarily used for separating oil-water emulsion into components is used in the step. As a commercialized surfactant provided with such specific properties, those which are respectively anionic, cationic, non-ionic and amphoteric have been generally known, and any one of them may be used.

However, those which severely make foams in the case of admixing with the mixture of the heavy oil and the viscosity-controlling agent by stirring or form emulsion in such a case are not desirable because of the difficulty in the separating procedure thereafter. Accordingly, those used generally for separation of oil and water as a de-foaming agent or those having de-emulsifying property are suitable. For instance, as an anionic surfactant, those of salts of alkyl- or aryl sulfate or sulfonate with their alkyl- or aryl group modified to be ester or ether by acid or alcohol are also included. As a cationic surfactant, those derived from alkyl amides, quarternary ammonium salts or alkyl-modified imidazolines are included. As a non-ionic surfactant, polyoxyethylenealkylphenyl ether, polyoxyethylene-modified alkyl aryl ether, polyethyleneglycol alkyl ether, sorbitan fatty acid ester, fatty acid monoglyceride or the like is used.

In the present invention, in the case where Q.I. is removed from the mixture containing the heavy oil as the agglomerated particles, not only the de-emulsifying effect, the de-foaming effect and other effects of the commercialized surfactant but also the conditions of stirring of the mixture of the heavy oil and the viscosity-controlling agent are the important factor on which the result of agglomeration of Q.I. and the separation of the thus agglomerated particles depend. This is a remarkable new finding of the present inventors.

The surfactant is used in an amount of 0.1 to 10% by weight of the amount of the heavy oil as the starting material. In the case of more than 10%, not only its effect of removing Q.I. seems to be saturated but also the state of coagulation of Q.I. tends to be worse. On the other hand, in the case of less than 0.1%, it becomes impossible to maintain the amount of Q.I. of the purified heavy oil less than 100 ppm. It has been found by the present inventors that the amount of Q.I. of the purified heavy oil can be controlled by adjusting the amount of the surfactant and the amount of Q.I. can be reduced to the aimed value of less than 50 ppm by using the surfactant in amount of 1 to 3% by weight of the amount of the heavy oil.

The surfactant is added into the mixture of the heavy oil and the viscosity-controlling agent under agitation. In this occasion, the surfactant dissolved in the mixture takes the minute solid impurities (Q.I.) in the heavy oil onto its molecular surface to agglomerate the minute solid impurities (Q.I.) into larger particles. The thus agglomerated particles further agglomerate in the mixture. It is considered preferable in this case to raise the extent of contact between the surfactant molecule and the minute solid impurities (Q.I.), i.e. to increase the frequency of contact between them per unit volume of the whole system composing of the heavy oil, the viscosity-controlling agent and the surfactant for the growth of agglomerating particles consisting of the surfactant and Q.I. However, it has been found by the present inventors that in the case of too-hard mixing, some of the agglomerated particles still remain in the mixture after subjecting to the next step of separation and removal of the agglomerated particles resulting in the difficulty of reducing the amount of Q.I. in the purified heavy oil to the aimed extent.

Such a moderate mixing by stirring which characterizes the present invention depends on a number of factors such as the kinds of the heavy oil as the starting material, the viscosity-controlling agent and the surfactant used, the temperature of the mixture of the heavy oil an the viscosity-controlling agent, the structure of the apparatus for stirring and the other conditions of the procedure, and accordingly, it is not easily defined unitarily. However, it will be expressed generally by the amount of energy consumption as the motive force giving rise to a turbulence of flowing liquid.

Namely, it has been found by the present inventors that in the case where a purified heavy oil, containing less than 50 ppm of the amount of Q.I., is to be prepared as the raw material for producing carbon fiber, it is necessary to operate the admixing of the surfactant with the mixture of the heavy oil and the viscosity-controlling agent of a viscosity of 5 to 100 cp at an energy consumption of 0.5 to 50 $w/m^3$ of the total volume of the admixing system as the parameter of mixing by stirring. In the case of less than 0.5 $w/m^3$, the removal of Q.I. originally contained in the heavy oil becomes insufficient in the step of separation and removal, and on the other hand, in the case of more than 50 $w/m^3$, the once agglomerated minute solid impurities as a larger particles are broken to be re-dispersed into the whole system resulting further in bubbling and foaming due to the entanglement of air and in the raise of the amount of Q.I. in the purified heavy oil.

In addition, the following is an exemplification of a concrete condition of stirring for admixing the surfactant with the mixture of the heavy oil and the viscosity-controlling agent, however, the present invention is not restricted by the exemplification.

In a vessel for the admixing by stirring provided with a stirrer with 4 paddle-type 30° to 45° twisted (to horizontal plane) blades with the ratio of length of the blade to the diameter of the vessel of 0.5 to 0.7, the ratio of width of the blade to the diameter of the vessel of 0.08 to 0.12 and the position of the blade at $\frac{1}{4}$ to 1/3 of the liquid depth from the bottom of the vessel, in the case where the direction of rotation of the stirrer is selected to give an upward flow to the mixture in the vessel, a standard of number of rotation is 30 to 400 r.p.m. for preparing the purified heavy oil for producing carbon material for general use, and 50 to 150 r.p.m. for preparing the purified heavy oil for producing carbon fiber, the time of operation being about 60 min.

(C) The step of subjecting the mixture to centrifugal separation

In this step, the mixture of the heavy oil and the viscosity-controlling agent containing the agglomerated larger particles of Q.I. obtained in the former step is subjected to centrifugal separation in a centrifugal precipitator or centrifugal filter while applying a centrifugal force of $3\times10^5$ to $12\times10^5$ G.sec to separate the agglomerated particles contained in the mixture. As has been described, the addition of the viscosity-controlling agent into the heavy oil in the former step is to facilitate the centrifugal separation in this step by reducing the viscosity of the mixture, and the present step is easily carried out in an ordinary centrifugal machine provided with an ordinary centrifugal effect at centrifugal force for a necessary period of time to separate and remove Q.I. contained in the larger particles present in the mixture.

(D) The step of distillation

The thus separated mixture of the heavy oil and the viscosity-controlling agent and the solid impurities (Q.I.) are respectively subjected to distillation under an ordinary pressure to fractionate the light fraction, which may be used as the viscosity-controlling agent for the step (A) in circulation.

The present invention will be concretely explained while referring to non-limitative examples as follows:

In addition, the method for determining the amount of Q.I. of the heavy oil is as follows: (For reference, Japanese Industrial Standards (JIS) K-2425 discloses the method for determining the amount of Q.I. present in oils of petroleum origin or of coal origin to the lower limit of 500 ppm, however, the method in the present invention is higher in sensitivity to the lower limit of a few ppm).

About 10 times by volume of quinoline is added to the heavy oil as a specimen, and after heating the mixture under agitation at 80° C. for 30 min, the mixture is filtered by a filter paper made of unwoven glass fibers and of a reservation diameter of 0.5 micron, and after washing the solid residue on the filter paper with quinoline and benzene, the solid residue is dried at 110° C. for 30 min. After cooling the dried solid residue to room temperature, it is weighed, and its weight is represented by ppm to the weight of the heavy oil as a specimen.

The rate of formation of solid impurities is the ratio of the weight of the solid substance separated in the step of separation and removal, dried at 110° C. for 30 min and cooled to room temperature to the weight of the heavy oil as a specimen.

In addition, the purified heavy oil obtained according to the process of the present invention is suitable as the raw material for producing the easily graphitizable coke used for preparing UHP electrodes and gland packings for pumps, and carbon materials such as isotropic- and heterotropic carbon fibers and activated carbon of high quality.

EXAMPLE 1

Figure 2A:
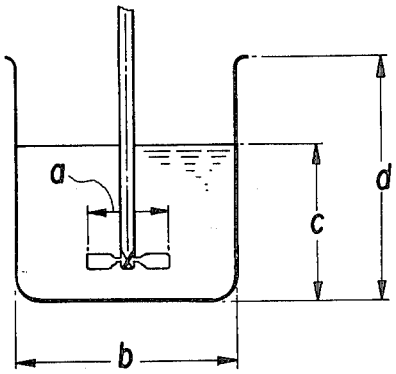
FIG. 2*a* shows a vertical cross-sectional view of a mixing vessel provided with a stirrer.
Figure 2B:
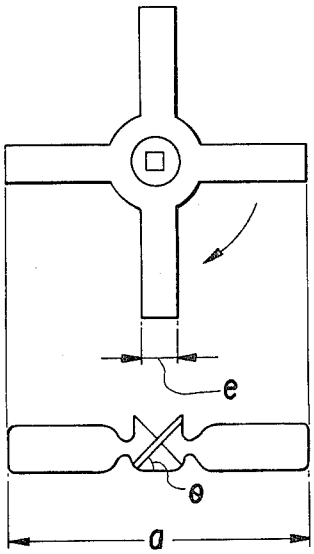
FIG. 2*b* is an enlarged of the stirrer.

Into a mixing vassel provided with a hot water bath and a stirrer shown in FIGS. 2*a* and 2*b* wherein a is the length of the blade (70 mm), b is the diameter of the vessel (116 mm), c is the liquid depth (100 mm), d is the depth of the vessel (140 mm), e is the width of the blade (10 mm) and $\theta$ is the angle of twist (30°), three runs of purification of coal tar of the properties shown in Table 1 were carried out twice, respectively.

Figure 4:
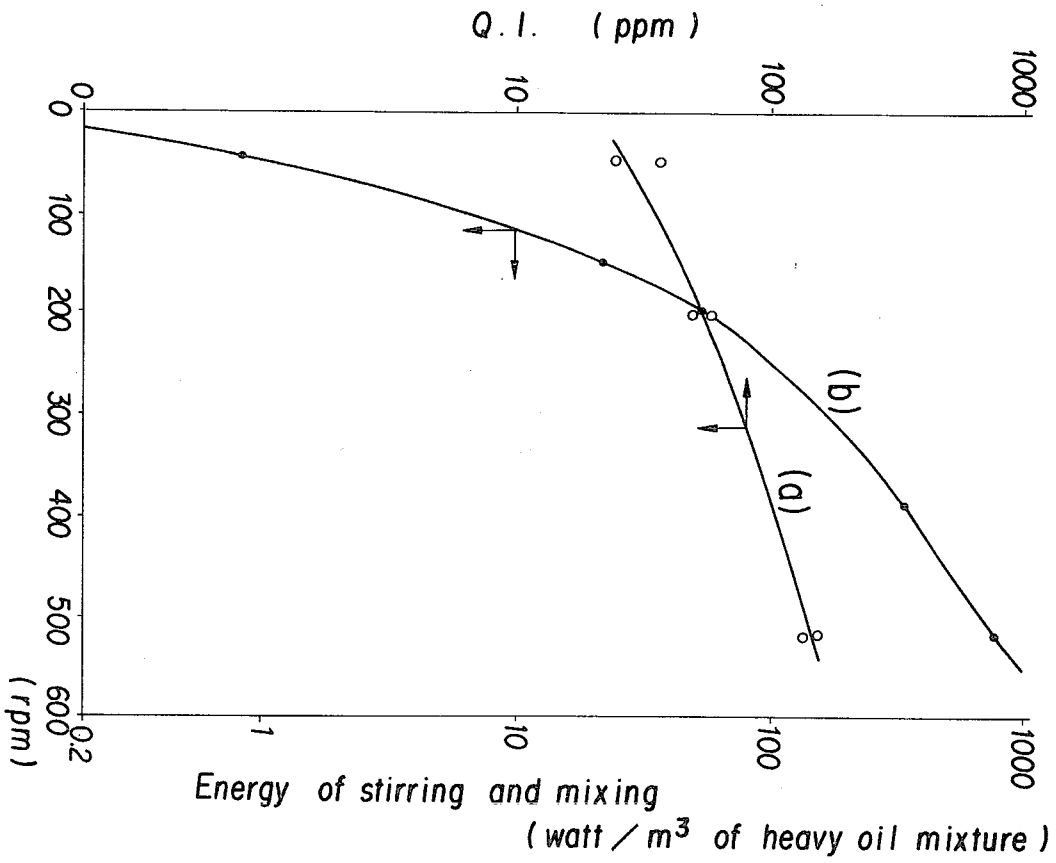
FIG. 4 shows the relationship between Q.I. or energy of stirring and mixing taken in the ordinate and the rotation number taken in the abscissa.

After introducing the coal tar, benzene as the viscosity-controlling agent and a surfactant (Ex-3, manufactured by Toho Chem. Ind. Co., Ltd.) into the mixing vessel at the respective amounts shown in Table 2 and the content of the vessel was treated under the conditions shown also in Table 2 at the number of rotation of the stirrer of 50, 220 and 520 r.p.m., respectively in Runs 1, 2 and 3 in bringing Q.I. into agglomeration, and then the mixture containing the thus agglomerated large particles was subjected to centrifugal separation at a centrifugal force of $6\times10^5$ G.sec to remove Q.I. originally contained in coal tar as a form of agglomerated large particles and to obtain the mixture apparently removed of the particles. After subjecting the thus obtained mixture to distillation to remove the light fraction containing benzene, the purified coal tar was obtained. The steps of the process was the same as shown in FIG. 1, and the amount of residual Q.I. in the product, the purified coal tar, was determined by the method described above and the values are illustrated in the ordinate of FIG. 4 while taking the number or rotation of the stirrer in the abscissa as a curve (a). It can be understood from the curve (a) in FIG. 4 that the amount of Q.I. in the product is raised as the number of rotation of the stirrer increases from 50 to 520 via 220 r.p.m. and in addition that in order to prepare the purified coal tar of the content of Q.I. of less than 100 ppm preferably suitable for producing carbon fiber it is necessary to rotate the stirrer at a rotating number of less than 390 r.p.m., and in particular to prepare that of the content of Q.I. of less than 50 ppm, it is necessary to choose the r.p.m. of less than 150 in the case where other conditions of operation than the r.p.m. are the same. In the apparatus shown in FIG. 2, the necessary net energy for mixing of giving the r.p.m. of 390 is 340 w/m$^3$ of the total volume of the mixture of coal tar, the viscosity-controlling agent and the surfactant, and that for giving the r.p.m. of 150 is only 22 w/m$^3$. The necessary amount of net energy for mixing vs. the r.p.m. was calculated from the curve 3 of FIG. 18.9 at page 1079 of "Manual of Chemical Engineering (Japan)", Ed. 3, published by Maruzen Book Seller (Japan) and is shown in the curve (b) of FIG. 4.

TABLE 1

Physical properties of heavy oils

| Physical property | Raw material: Coal tar | Raw material: Residual oil of distillation of ethylene (EBO) |
|---|---|---|
| Fixed carbon (% wt.) | 12.0 | 9.0 |
| Sulfur (% wt.) | 0.47 | 1.5 |
| Molecular ratio of H/C | 0.72 | 1.25 |
| Benzene-insoluble component (% wt.) | 4.1 | 1.5 |
| Quinole-insoluble component (ppm) | 21,000 | 6,000 |
| Distillation property: | | |
| Fraction up to 200° C. (% wt.) | 2.1 | 0.2 |
| Fraction up to 250° C. (% wt.) | 12.7 | 21.5 |
| Fraction up to 300° C. (% wt.) | 30.3 | 62.0 |
| Fraction up to 350° C. (% wt.) | 49.0 | 78.0 |
| Residue over 350° C. (% wt.) | 51.0 | 22.0 |

TABLE 2

Operating conditions in Example 1

| | |
|---|---|
| Surfactant | Ex-3 (made by Toho Chem. Ind., Co.) |
| Amount of the surfactant | 3% by weight of the heavy oil |
| Viscosity-controlling agent | Benzene |
| Weight ratio of benzene to the heavy oil (coal tar) | 1 |
| Temperature of admixing | 50° C. |
| Viscosity of the mixture of the heavy oil and benzene | 10 cp at 50° C. |
| Rotation number in stirring | 50, 220 or 520 r.p.m. |
| Time for stirring | 60 min. |
| Centrifugal force at separation of the agglomerated particles | $6\times10^5$ G · sec |
| Temperature at separation of the agglomerated particles | 50° C. |
| Cut temperature in distillation of light fraction | 200° C. |

EXAMPLE 2

Figure 3:
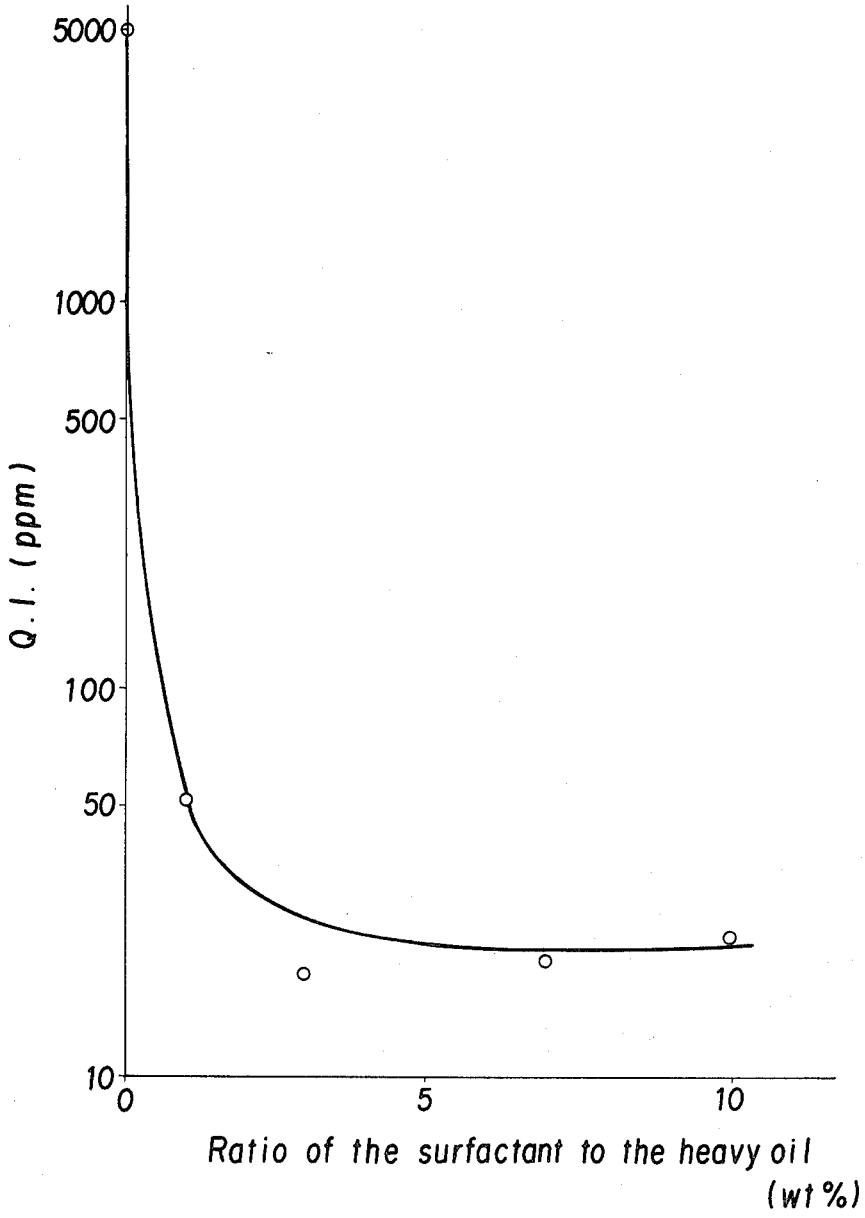
FIG. 3 shows the relationship between the percentage by weight of the surfactant to the heavy oil taken in the abscissa and the amount of the quinoline-insoluble minute solid impurities (abbreviated and referred to as Q.I.) ordinate.

In the same manner as in Example 1, except for using Sanfloc C-450 (a cationic surfactant made by Sanyo Kasei Ind. Co., Ltd.), changing the amount of Sanfloc C-450 from 1, 3, 7 and 10% by weight of the heavy oil, however, keeping the rotation number of the stirrer for mixing at a fixed value of 50 r.p.m., purification of the same coal tar as in Example 1 (refer to Table 1) was carried out while using the apparatus shown in FIG. 2 to examine the relationship between the concentration of the surfactant in the mixture of the coal tar and the surfactant and the Q.I. value of the purified coal tar. The results are shown in Table 3 and FIG. 3. As are seen from the data in FIG. 3, as the concentration of the surfactant increases, the Q.I. value is reduced, however, the effect is progressively reduced as the concentration increases, in other words, the effect become saturated.

shown in FIG. 1, and the amount of Q.I. in the thus purified coal tar or bottom oil as the heavy oil.

For reference, in the present Example experiments have been carried out to see the fluctuation of the amount of Q.I. by the difference of the kind of the heavy oils, and of the kind of the surfactants used in each run of removal of the impurities.

TABLE 4

| | Example 3 | | | | | | | | Comparative Example 1 |
|---|---|---|---|---|---|---|---|---|---|
| Run No. | 1 | 2 | 3 | 4 | 5 | 6 | 7 | 8 | 9 |
| Kind | Cationic | | | | Anionic | | Non-ionic | | |
| Surfactant Name[1] | A | B | C | C | D | D | E | E | not used |
| Admixing | | | | | | | | | |
| Heavy oil | coal tar | coal tar | coal tar | E.B.O. | coal tar | E.B.O. | coal tar | E.B.O. | coal tar |
| Amount of the surfactant (% wt.) | 3 | 3 | 3 | 3 | 3 | 3 | 3 | 3 | — |
| Weight ratio of benzene to the heavy oil | 1 | 1 | 1 | 1 | 1 | 1 | 1 | 1 | 1 |
| Temperature of admixing (°C.) | 50 | 50 | 50 | 50 | 50 | 50 | 50 | 50 | 50 |
| Time for stirring (min.) | 60 | 60 | 60 | 60 | 60 | 60 | 60 | 60 | 60 |
| Rotation number in stirring (r.p.m.) | 50 | 50 | 50 | 50 | 50 | 50 | 50 | 50 | 50 |
| Energy for mixing (w/m$^3$) | 0.97 | 0.97 | 0.97 | 0.97 | 0.97 | 0.97 | 0.97 | 0.97 | 1.30 |
| Separating of Q.I. | | | | | | | | | |
| Temperature of Separating (°C.) | 50 | 50 | 50 | 50 | 50 | 50 | 50 | 50 | 50 |
| Viscosity of the object (c.p.) | 10 | 10 | 10 | 7 | 10 | 7 | 10 | 7 | 75 |
| Centrifugal force (G · sec) | $6 \times 10^5$ | $6 \times 10^5$ | $6 \times 10^5$ | $6 \times 10^5$ | $6 \times 10^5$ | $6 \times 10^5$ | $6 \times 10^5$ | $6 \times 10^5$ | $6 \times 10^5$ |
| Rate of formation of agglomerated particles (% wt.) | 11.0 | 11.2 | 11.7 | 1.0 | 11.3 | 0.8 | 11.1 | 1.1 | <1 |
| Cut temperature of light oil fraction (°C.) | 200 | 200 | 200 | 200 | 200 | 200 | 200 | 200 | 200 |
| Q.I. in the purified heavy oil (ppm) | 38 | 27 | 22 | trace | 16 | trace | 20 | 11 | 5000 |

Note:[1]
A: Ex-3 (alkylhydroxyethylimidazoline as the main component) made by Toho Chem. Ind. Co., Ltd.
B: No. 5721 (alkylamide derivative as the main component) made by Takemoto Oil & Fats Co., Ltd.
C: Sanfloc C-450 (polyaminepolyacrylamide as the main component) made by Sanyo Kasei Ind. Co., Ltd.
D: Sandet BL (Sodium alkyldiphenylether-disulfonate as the main component) made by the same as above.
E: No. 5724 (polyoxyethylene modified alkylaryl ether.) made by Takemoto Oil & Fats Co., Ltd.

TABLE 3

| | Example 2 | | | | |
|---|---|---|---|---|---|
| Amount of surfactant (% wt of the heavy oil) | 0 | 1 | 3 | 7 | 10 |
| Heavy oil (raw material) | coal tar | | | | |
| Weight ratio of benzene to heavy oil | 1 | | | | |
| Temperature in admixing (°C.) | 50 | | | | |
| r.p.m. in admixing | 50 | | | | |
| Duration of admixing (min) | 60 | | | | |
| Temperature of admixture on separation (°C.) | 50 | | | | |
| Viscosity of admixture (cp) | 10 | | | | |
| Centrifugal force (G · sec) | $6 \times 10^5$ | | | | |
| Rate of formation of Q.I. (% by wt.) | 0.5 | 8.7 | 11.6 | 12.1 | 11.9 |
| Cut temperature of light oil fraction (°C.) | 200 | | | | |
| Q.I. in the purified heavy oil (ppm) | 5,000 | 51 | 18 | 20 | 23 |

EXAMPLE 3

Into a mixing vessel provided with a hot water bath and a stirrer shown in FIG. 2, coal tar or bottom oil of petroleum cracking (E.B.O.) with their physical properties shown in Table 1, benzene as a viscosity-controlling agent and one of the surfactants shown in Table 4 were introduced, and the mixture was treated under the conditions shown in Table 4 to carry out the removal of Q.I. from coal tar or E.B.O. according to the steps As are seen in Table 4, the Q.I. (quinoline-insoluble minute solid impurities) of the purified heavy oil (the product of the process according to the present invention) could be reduced to less than 50 ppm when the surfactant commercialized for use in separation of a mixture of water and oil into its components, was used in amount of 3% by weight to the heavy oil under the conditions adopted.

In addition, tests were carried out for producing carbon fiber while using the purified heavy oils respectively obtained by Run Nos. 1 and 3 of Example 3 as follows:

Namely, 5% by weight of 70% nitric acid was admixed with the purified heavy oil, and after heating the mixture to 300° C. and holding the mixture at the temperature for 2 hours under ordinary pressure, the mixture was subjected to distillation under a reduced pressure to collect the intermediate fraction boiling at 200° to 350° C. as a hard pitch. After melt-spinning the hard pitch at 230° to 260° C. to prepare pitch fibers, the pitch fibers were subjected to infusibilization in an oxidative atmosphere by heating the fibers from 110° to 230° C. at a rate of temperature raise of 1.4° C./hour and keeping the fibers at 230° C. for 0.5 hours. In the melt-spinning, the spinning property of the hard pitch was favorable without any breakage of the fibers during spinning, the fact showing the sufficient removal of Q.I. from the heavy oil as the starting material.

The thus infusibilized fibers were subjected to carbonization by heating them in an inert atmosphere at 50° C. for 1 hour and further heating as it is to 850° C. at a constant rate of temperature raise of 6.7° C./hour to obtain carbon fibers. The physical states of the thus obtained hard pitch and the carbon fibers are respectively shown in Tables 5-1 and 5-2. These states are the same as or superior to those of the hard pitch or the carbon fibers obtained by the conventional process such as the process using solvent. In Table 5-1, n-heptane-insoluble component and benzene-insoluble component were respectively determined according to the method in Japanese Industrial Standards (JIS) K-2425.

TABLE 5-1

| Physical properties of Hard Pitch | | |
|---|---|---|
| Raw material | Run No. 1 | Run No. 3 |
| n-heptane-insoluble component (% wt.) | 91.7 | 90.7 |
| benzene-insoluble component (% wt.) | 49.4 | 48.8 |
| Quinoline-insoluble component (ppm) | 76 | 44 |
| Softening point (°C.) | 162 | 160 |
| Pour point (°C.) | 193 | 191 |
| Yield of pitch (% wt.) | 39.7 | 40.1 |

TABLE 5-2

| Physical properties of Carbon Fiber | | |
|---|---|---|
| Raw material | Run No. 1 | Run No. 3 |
| Diameter (micron) | 12~14 | 12~14 |
| Tensile strength (kg/mm$^2$) | 93 | 94 |
| Young's modulus (kg/mm$^2$) | 3320 | 3260 |
| Elongation at break (%) | 2.80 | 2.88 |

COMPARATIVE EXAMPLE 1

In the same manner as in Example 3 except for not-using any surfactant, the heavy oil is treated to obtain a purified heavy oil, however, as is seen in the right-most column of Table 4, the removal of the quinoline-insoluble component was insufficient. Accordingly, in the test for producing carbon fibers from the thus obtained heavy oil, fiber-breaking during the spinning from the pitch prepared from the heavy oil frequently occurred and the fiber-forming property was also poor with the poor physical properties of baked up fibers.

What is claimed is:

1. A process for preparing heavy oil containing less than 300 ppm of quinoline-insoluble, minute solid impurities as a raw material for carbon materials, comprising the steps of:

admixing (1) an organic solvent having a boiling point lower than 150° C., as a viscosity-controlling agent, and (2) a surfactant soluble in heavy oil of coal origin or petroleum origin in an amount of 0.1 to 10% by weight of the heavy oil, with (3) a heavy oil of coal origin or petroleum origin;

stirring gently the resultant admixture at a net motive power for mixing of 0.5 to 50 w/m$^3$ of the admixture;

subjecting the thus stirred admixture to centrifugal separation thereby separating the admixture into solid impurities and an oily liquid; and distilling, repsectively, the thus separated oily liquid to remove light fraction from the oily liquid to obtain the heavy oil as a raw material for carbon materials and the solid impurities to recover light fraction therefrom;

wherein said surfactant is a de-foamant selected from the group consisting of anionic surfactants, cationic surfactants and non-ionic surfactants.

2. The process according to claim 1, wherein said surfactant is a non-ionic surfactant selected from the group consisting of polyoxyethylenealkylphenyl ether, polyoxyethylene-modified alkyl aryl ether, polyethylene-glycol alkyl ether, sorbitan fatty acid ester and fatty acid monoglyceride.

3. The process according to claim 1, wherein said surfactant is a cationic surfactant selected from the group consisting of alkyl amide, quaternary ammonium salt and alkyl-modified imidazoline.

4. The process according to claim 1, wherein said surfactant is an anionic surfactant selected from the group consisting of modified alkyl sulfate, modified alkyl sulfonate, modified aryl sulfate and modified aryl sulfonate.

5. The process according to claim 1, wherein said organic solvent is selected from the group consisting of aromatic hydrocarbons, ketones, ethers, or esters.

6. The process according to claim 5, wherein said aromatic hydrocarbon is benzene, toluene or xylene.

7. The process according to claim 1, wherein said organic solvent is added in an amount so as to adjust the viscosity of the admixture to less than 10 cp at 50° C.

8. The process according to claim 1, wherein said organic solvent is added in an amount nearly equal to the amount of said heavy oil.

* * * * *